United States Patent [19]

Duke

[11] 4,240,168

[45] Dec. 23, 1980

[54] COMBINATION COMMODE CONSTRUCTION

[76] Inventor: James I. Duke, Rte. 2, Box 5A, Curryville, Mo. 63339

[21] Appl. No.: 19,466

[22] Filed: Mar. 12, 1979

[51] Int. Cl.[3] ..... E03D 1/14; E03D 1/36; E03D 5/02

[52] U.S. Cl. ..... 4/326; 4/366; 4/405; 4/413; 137/441

[58] Field of Search ..... 4/301, 303, 311, 313, 4/324–328, 340–342, 345, 346, 363–367, 378, 392, 393, 405, 413, 430, 249; 137/101, 118, 423, 426, 441, 861, 391

[56] References Cited

U.S. PATENT DOCUMENTS

| | | | |
|---|---|---|---|
| 340,121 | 4/1886 | Hyde | 4/303 X |
| 560,740 | 5/1896 | McCartney | 4/342 |
| 644,488 | 2/1900 | Adams | 4/342 |
| 1,027,342 | 5/1912 | Kämmer | 4/342 X |
| 1,225,691 | 5/1917 | Williams | 4/303 X |
| 1,519,112 | 12/1924 | Burger | 4/341 |
| 2,000,971 | 5/1935 | Schmiedeknecht | 137/861 X |
| 2,715,228 | 8/1955 | McLanahan | 4/363 X |
| 2,783,475 | 3/1957 | Sturman | 4/324 |
| 3,336,602 | 8/1967 | Kubit | 4/301 X |
| 3,947,900 | 4/1976 | Duke | 4/341 X |

FOREIGN PATENT DOCUMENTS

| | | | |
|---|---|---|---|
| 311845 | 4/1919 | Fed. Rep. of Germany | 4/342 |

*Primary Examiner*—Stuart S. Levy
*Attorney, Agent, or Firm*—Haverstock, Garrett & Roberts

[57] ABSTRACT

An improved combination commode construction including a water closet common to a plurality of commodes, a plurality of separate commode control assemblies on the water closet, each of which assemblies is associated with a respective commode and is actuatable for effecting flushing of the commode with which it is associated, and flushing apparatus to control the amount of flush water used in the flushing of each commode, the flushing apparatus including a refill water construction for providing refill water to the water closet and the commodes, the flushing apparatus also including a refill control assembly responsive to actuations of each of the separate commode control assemblies for directing and supplying refill water from the refill water construction to the respective commode with which the actuated separate commode control assembly is associated, the refill control assembly being further responsive to actuations of the separate commode control assemblies to inhibit supply of refill water to commodes not associated with the actuated separate commode control assembly.

19 Claims, 5 Drawing Figures

COMBINATION COMMODE CONSTRUCTION

The present invention relates to an improved combination commode construction, and more particularly to an improved combination commode construction employing a common water closet for a plurality of commodes wherein different amounts of flush water may be used for the flushing of different of the commodes and wherein means are provided for directing the refill water specifically to the particular commode flushed and for inhibiting supply of refill water to the non-flushed commodes.

In the past it has been common practice in lavatory installations to provide a water closet in association with a commode and to include on the water closet means for flushing the commode. Although this has been quite acceptable and adequate under most circumstances, other instances have arisen in which it has been found desirable to be able to employ more than a single commode with a particular water closet, and various constructions, including such as those disclosed in U.S. Pat. Nos. 340,121; 560,740; 644,488; 1,027,342, and German Pat. No. 311,845, have therefore been designed to permit the flushing of a plurality of commode or urinal units with flush water supplied from a single water closet. Such constructions, though, despite their advantages, still did not permit the separate and independent flushing of each of the distinct commode or urinal units and, consequently, required relatively large amounts of water to maintain all of the commodes in a flushed condition. In a different vein, it was also recognized that in some instances it might be desirable to employ different sized toilet bowls in a commode unit. For instance, as disclosed in U.S. Pat. No. 1,519,112, a standard sized toilet bowl could be employed for adult use and a smaller sized toilet bowl could be employed for use by infants and children. It has further been recognized, as disclosed in U.S. Pat. No. 3,336,602, that by providing a commode unit having a combination of two toilet bowls wherein a small urinal bowl is an integral part within a larger toilet bowl, which commode unit also has means for flushing the smaller urinal bowl independently from the larger toilet bowl, significant amounts of water could be saved if only the urinal bowl were required to be flushed. Such constructions, however, did not provide means to allow each of the bowls to be separately and independently flushed, and did not provide for distinct commode units, each of which might have different flush water requirements and which could be separately and independently flushed with flush water provided from a common water closet. In my previous U.S. Pat. No. 3,947,900 I disclosed a combination commode construction wherein the same water closet is used to provide the flush water for flushing two or more different commodes, which may be of different sizes and have different flush water requirements, and wherein there are provided both separate controls on the water closet to enable the individual selective flushing of each of the different commodes and also other means to control the amount of flush water required for flushing each commode. By employing a common water closet for a plurality of commodes and controlling the amount of flush water used in the flushing of the different sized commodes, a significant conservation of water was realized. However, I have found that a modification to the construction described in my previous above-identified patent improves the water conservation characteristics of my basic combination commode invention, as well as the operation thereof, and is a significant improvement thereover.

My present invention relates to an improved combination commode construction where different amounts of flush water may be used for the flushing of different of the commodes, and wherein the flush water is supplied from a common water closet which has separate commode control means therewith for the respective commodes as well as flushing means for effecting flushing of each of the commodes, the flushing means including refill means and means responsive to actuation of the separate commode control means for directing water from the refill means to the respective commode with which the actuated separate commode control means is associated. By directing the water from the refill means to the particular commode being flushed instead of to all the commodes or to some one or more pre-established commodes, water conservation is increased because the refill water is being directed to the flushed commode and not to non-flushed commodes, thereby enhancing the operation of the particular flushed commode while minimizing water flow to non-flushed commodes during each flushing operation.

It is therefore a principal object of the present invention to conserve water used in the flushing of commodes.

Another object is to provide means in a combination commode construction that employs a common water closet for supplying and directing refill water to the particular commode flushed.

Still another object is to minimize water flow to non-flushed commodes of combination commode constructions that employ a common water closet.

A further object is to provide an improved combination commode construction.

Another object is to provide a more water efficient combination commode construction.

A still further object is to be able to use known and readily available components to modify existing combination commode constructions to increase water conservation.

Another object is to increase the water savings that can be realized by the use of combination commode constructions.

A further object is to improve the flushing operation of each commode in a combination commode construction by providing refill water thereto during its flushing operation.

Another object is to make it relatively simple and inexpensive to increase water conservation of combination commode constructions.

These and other objects and advantages of the present invention will become apparent after considering the following detailed specification, which discloses a preferred form of the present device, in conjunction with the accompanying drawing, wherein.

Figure 1:
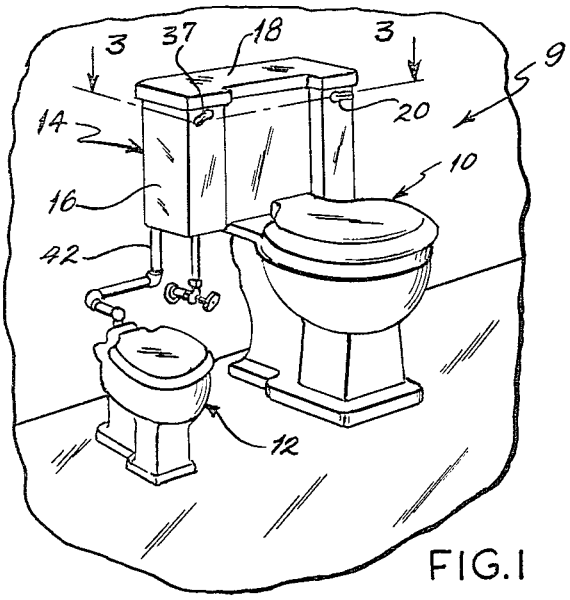
FIG. 1 is a perspective view showing a combination commode construction with several commodes connected to a common source of flushing water.

Referring to the drawing more particularly by reference numbers, number 9 in FIG. 1 refers to a combination commode construction which includes a standard type and sized commode 10 such as is commonly found in houses and public restrooms and a second commode 12 similar in construction to the commode 10 but smaller in size in order to better accomodate children. Associated with the commodes 10 and 12 is a water closet 14 which is common to both commodes 10 and 12 and which has some features that are more or less conventional and other features which differ from and distinguish water closet 14 from conventional water closets. The water closet 14 includes a water tank housing 16, a lid 18, and separate control handles or levers 20 and 37 which are used to control the separate and independent flushing of commodes 10 and 12 in a manner which will be described hereinafter.

Figure 2:
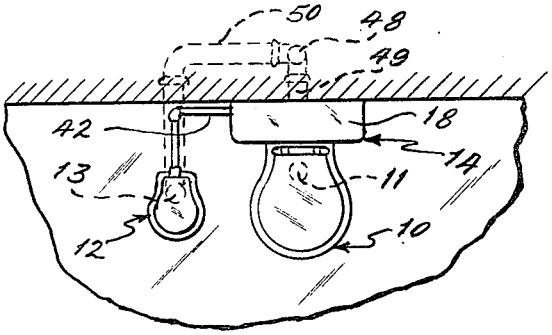
FIG. 2 is a top plan view of the construction depicted in FIG. 1.

As may be best seen from FIG. 2, the two commodes 10 and 12 each have outlets respectively identified by the numbers 11 and 13, which outlets communicate respectively, in conventional fashion, such as by means of a trap construction, with pipes 49 and 50 which are connected to discharge into a common sewer line 48. Consequently, when either of the levers 20 or 37 is operated, the respective commode 10 or 12 is flushed, discharging the matter to be flushed and flush water through the appropriate pipe 49 or 50 to sewer line 48.

In the construction shown in FIG. 1 the larger commode 10 receives its flush water from the water closet 14 through an outlet port associated with valve seat 22 (FIG. 5), which valve seat also has associated therewith valve means, such as the movable flapper member 24, that cooperates with the valve seat 22 during a flushing operation to control the passage of flush water through the outlet port. Movement of flapper member 24 from a closed to an open position relative to valve seat 22 is effected by operation of flushing means associated with the water closet 14, which flushing means include lever 20, connecting arm 26, and flapper trip means, such as trip chain 28. In the embodiment depicted, connecting arm 26 (as best shown in FIG. 5) includes a trip portion 26A, one end of which is connected to lever 20 and the other end of which has a tang portion 26B projecting angularly therefrom, the purpose of which will become clear from that which follows. The trip chain 28 is connected between the trip portion 26A and movable flapper member 24 such that when the operating lever 20 is actuated movable flapper member 24 is lifted off its associated valve seat 22 thereby allowing the water in the water closet 14 to pass out through the outlet port associated with valve seat 22 into the pipe 29 and into the commode 10 in a conventional manner. The amount of water that is used to flush the commode is controlled by the location or elevation of the outlet port or valve seat 22 in the tank 14 and by the capacity of the tank. When a flushing operation has been effected and all or nearly all of the water in the tank 14 has escaped through the outlet port 22, float means, such as float ball 30 which is mounted on the end of float control rod 32, will have fallen to a lowered position from that shown in FIG. 5. This will operate to open refill water control valve means 34 to cause water to be fed through refill tube 35 (FIGS. 4 and 5) into the water closet 14 to refill it with flush water for use in subsequent flushing operations. The refilling of the water closet tank 14 will continue until the valve means 34 are reclosed by operation of the float ball 30 in rising on the water surface to a predetermined level as the tank is being refilled.

The present construction has a second lever 37, similar to lever 20, which controls the flushing of the commode 12. The lever 37 is associated with a second outlet port and valve seat 38 which functions with flapper member 40, similar to the flapper member 24, to control the passage of water through outlet port 38. The outlet port and valve seat 38, which is positioned to be at an elevation in the tank, when used to flush a child's commode, that is higher than the valve seat and outlet port 22, communicates with a water outlet pipe 42 that is attached to the bottom of the water closet 14 and extends (as shown in FIG. 1) from the tank to the flush water inlet of the smaller commode 12. Lever 37, like lever 20, is connected to a connecting arm 44 similar to connecting arm 26. The connecting arm 44 has a trip portion 44A with a tang portion 44B at its free end and is connected by trip chain 46 to the flapper member 40, such that when the lever 37 is actuated flapper member 40 is caused to move upwardly away from the valve seat 38, thereby allowing flush water from the water closet 14 to pass through the elevated outlet port to outlet pipe 42 and then to the commode 12 for effecting the flushing thereof. Since outlet port and valve seat 38 is at a higher elevation within water closet 14 than is outlet port and valve seat 22, less flush water will be passed from the water closet 14 to the smaller commode 12 when lever 37 is actuated than would be passed to the larger commode 10 when lever 20 is actuated. The refill means, which includes the float ball 30, float control rod 32, and refill water control valve means 34, operates in much the same manner when lever 37 is actuated as when lever 20 is actuated, although the float ball 30 will not fall as low and less refill water will need to be provided to refill water closet 14. This means that when the smaller commode 12 is flushed less flush water will escape from the tank and be used, and this is an important advantage since it saves water.

It should also be recognized that the principles of the construction described may also be applied to a situation where two or more standard size commodes are to operate from the same water closet. This may be desirable in certain situations, including in public toilets, and if this is done, the same principles of operation apply. Consequently, it may be seen that two or more commodes may be operated off a common water closet, and the amount of flush water can be made to be the same or can be made to be different for the different commodes, as desired.

As has previously been indicated, actuation of either of the operating levers 20 or 37 will effect flushing of the respective commode 10 or 12, during which flushing operation water closet 14 will be refilled with water for use during the next flushing operation. Overflow tubes 60 and 62 are provided and associated respectively with each of the outlet port and valve seat constructions 22 and 38 for supplying refill water to the respective commodes 10 and 12 and for preventing overflow of the tank in the event of a refill water control valve means malfunction. Water passing through the tubes 60 and 62 bypasses the respective valve seat/-flapper member assemblies 22, 24 and 38, 40 and passes directly into commodes 10 and 12, regardless of the status of the respective valve seat/flapper member assemblies. The overflow tubes 60 and 62 have attached thereto near their upper ends cap or lid assemblies 64 and 66 respectively, which lid assemblies are interconnected by a connecting member 70 which extends therebetween and has a selector tab 72 extending sidewardly therefrom at an intermediate location along the length of connecting member.

Figure 3:
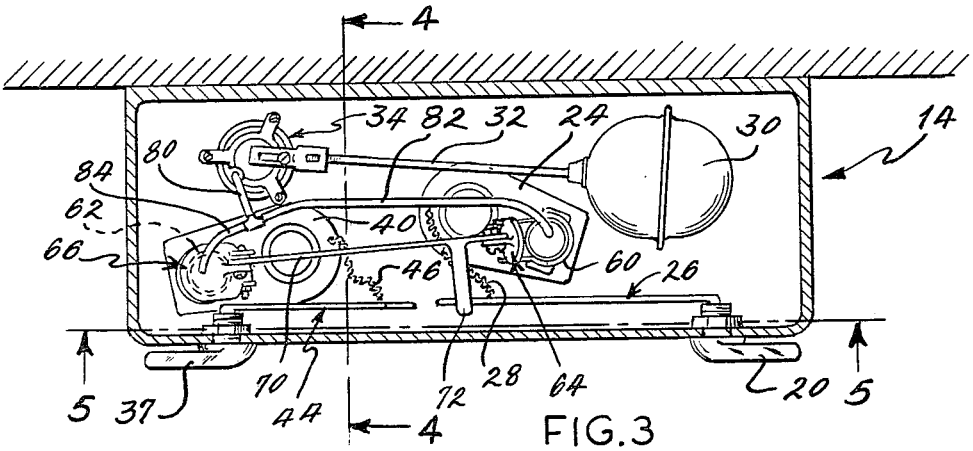
FIG. 3 is a cross-section view taken on line 3—3 of FIG. 1.
Figure 4:
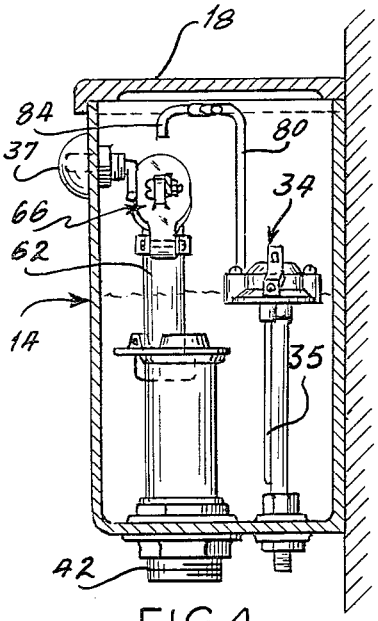
FIG. 4 is a cross-sectional view taken on line 4—4 of FIG. 3.
Figure 5:
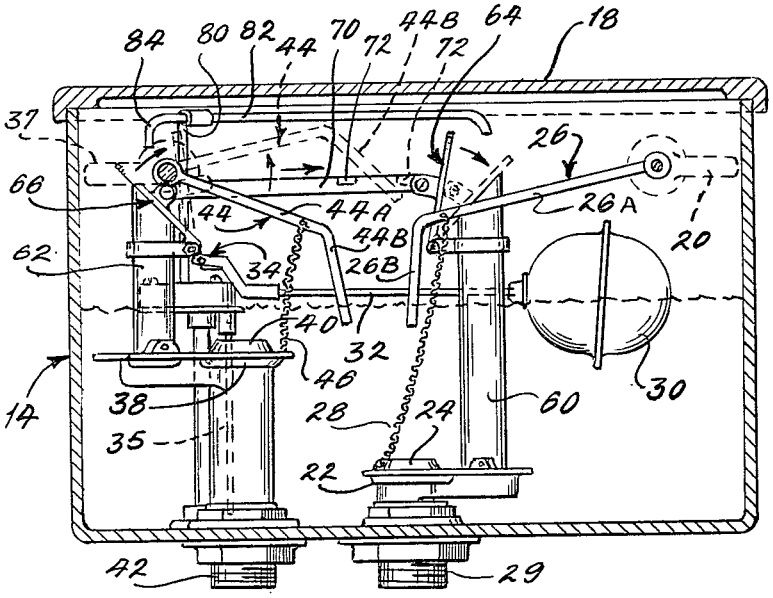
FIG. 5 is a cross-section view taken on line 5—5 of FIG. 3.

In the configuration depicted in FIGS. 3–5 lid assembly 66 is shown in solid outline in engagement with the upper end of overflow tube 62, thereby closing the tube, while lid assembly 64 is shown pivoted up and away from the upper end of overflow tube 60, thus leaving overflow tube 60 in an open state. If lever 37 is thereafter depressed, connecting arm 44 which is attached thereto will pivot upwardly as shown in dotted outline in FIG. 5, causing tang portion 44B thereof to move into engagement with the selector tab 72 on connecting member 70. As the upward pivotal movement of connecting arm 44 continues tang portion 44B exerts pressure upon selector tab 72 causing it and the connecting member 70 of which it is a part to move laterally from the position shown in solid outline in FIG. 5 to the position shown in dotted outline, thereby causing the attached lid assembly 64 to pivot downwardly to engage the upper end of overflow tube 60, thus closing that overflow tube, and causing the other attached lid assembly 66 to pivot upwardly to disengage from the upper end of overflow tube 62, thus opening such overflow tube. When lever 37 is released, allowing it to return to its normal non-actuated position, the connecting member 70 with its selector tab 72 will remain in the position as shown in dotted outline. Thereafter, further actuations of operating lever 37, while causing upward pivotal movement of the connecting arm 44 and flushing of the commode 12, will not result in any changes in position of the lid assemblies 64 and 66.

However, if, subsequent to an actuation of lever 37, the lever 20 is then depressed to effect flushing of the commode 10, pivotal upward movement of connecting arm 26 is effected causing the tang portion 26B thereof to move into engagement with the selector tab 72 (in dotted outline). As connecting arm 26 continues its upward movement the pressure exerted upon selector tab 72 by tang portion 26B causes connecting member 70 and its selector tab 72 to move laterally from the dotted outline position back to the solid outline position, thereby returning lid assemblies 64 and 66 to their original positions as shown in solid outline. Subsequent actuations of lever 37 will not thereafter result in any changes in position of the lid assemblies 64 and 66.

In view of what has been said, it will be appreciated that whenever the operating lever 20 is actuated to effect a flushing operation of the commode 10 the resulting position of the lid assemblies 64 and 66 will be such that overflow tube 60, which is associated with commode 10, will be open, and overflow tube 62, which is associated with commode 12, will be closed. Similarly, whenever operating lever 37 is actuated to effect flushing of commode 12, the resulting position of lid assemblies 64 and 66 will be such that overflow tube 62, which is associated with commode 12, will be open, and overflow tube 60, which is associted with commode 10, will be closed.

Whenever either of the operating levers is actuated a flushing operation will be initiated, and, as flush water from the water closet 14 passes out of the water closet through the appropriate outlet port 22 or 38, the water level in the water closet 14 will drop causing float ball 30 to move to a lowered position in the water closet 14, thereby causing refill water control valve means 34 to open. When this occurs refill water will not only be fed from the refill water control valve means 34 through tank refill tube 35 (FIGS. 4–5) to refill the water closet tank, as has previously been described, but will also be fed through tube 80 and the interconnected tube arms 82 and 84 towards the upper ends of the overflow tubes 60 and 62. Thus, actuations of lever 20 will cause refill water to be directed from refill water control valve means 34 into the water closet tank and, also, through tube 80 and tube arms 82 and 84 towards the tops of overflow tube 60 and 62. Since actuation of lever 20 results in the opening of overflow tube 60 and the closing of overflow tube 62, as has previously been described, the refill water passing through tube arm 82 will be directed into the top of open overflow tube 60 and therethrough to refill the toilet bowl of commode 10, while the refill water passing through tube arm 84 will be deflected by the closed lid assembly 66 at the top of overflow tube 62 into the water closet 14. Consequently, whenever lever 20 is actuated, refill water will be provided to commode 10, but not to commode 12. Similarly, if the operating lever 37 is actuated, refill water will be directed through tube arm 84 to the open overflow tube 62 and therethrough to the toilet bowl of commode 12, while refill water passing through tube arm 82 will be deflected by the closed lid assembly 64 at the top of overflow tube 60 into the water closet 14, thereby preventing refill water from being provided to non-flushed commode 10.

By directing refill water specifically to the commode being flushed and by inhibiting this water from being passed through the overflow tube associated with the non-flushed commode, each flushing operation is made more efficient and water conservation is enhanced. Providing refill water through the overflow tube to the flushed commode results in a better, more complete flushing operation and better cleansing of the toilet bowl of that commode. Inhibiting the flow of refill water to non-flushed commodes results in a water savings since water feed to those commodes is minimized. Preferably, one of the overflow tubes is always maintained in an open condition, as is the case with the particular embodiment hereinabove described, to ensure that the tank of the water closet 14 will not overflow in the event of a refill water control valve means malfunction. If the float ball 30 should become broken or if the refill water control valve means should fail in a valve-open condition so that refill water continues to be provided even after the tank has been refilled to its normal refill level, the open overflow tube would act to drain off any water cresting above the top of the overflow tube into the commode with which the open tube is associated, thereby preventing possible overflow of the water closet tank and attendant flooding of the surrounding area.

While the particular embodiment depicted in the drawing and described hereinabove employs overflow tubes that have fluted top ends adapted for engagement with the particular lid assemblies employed, it should be recognized that the top ends thereof need not be so fluted and that various other capping means and linkage means might equally well be employed. Additionally, it should also be recognized that the actions of specifically directing refill water to the commode being flushed and inhibiting flow thereof to nonflushed commodes could equally well be accomplished by other means than that described hereinabove, including by such means as a directional valve located at the intersection of the arms 82 and 84 and responsive to actuation of each of the levers 20 and 37 for directing refill water only through the particular arm associated with the commode being flushed. With such a construction no capping means whatsoever would be necessary although the same results could be achieved. Similarly, two distinct, complementary-acting valve means could be employed each in association with one of the arms 82 and 84, such that actuation of each operating lever would effect opening of one valve means to allow refill water to be supplied to the commode associated with that operating lever and the closing of the other valve means to prevent passage of refill water to the non-flushed commode not associated with the actuated operating lever.

It should further be appreciated that although the present invention has been described and depicted in association with floor-based commode units, other toilet units, such as wall-mounted urinal units and other flush type toilet bowl and urinal units, may also be equally as well employed, and all such flush type toilet units are considered to be included as specific types of commodes that could be employed with the present invention.

Thus, there has been shown and described a preferred embodiment of a novel improved combination commode construction, along with several possible modifications thereof, which fulfills all of the objects and advantages sought therefor. It will be apparent to those skilled in the art, however, that many changes, variations, modifications, and other uses and applications of the invention, in addition to those already mentioned and disclosed, are possible and contemplated. All such changes, variations, modifications, and other uses and applications which do not depart from the spirit and scope of the invention are deemed covered by the invention which is limited only by the claims which follow.

What is claimed is:

1. A water closet construction adapted to service a plurality of flush type toilet units comprising a water tank common to the plurality of toilet units for supplying flush water for each, a plurality of separate toilet unit control means on the water tank, each of which toilet unit control means is associated with a respective toilet unit and is actuatable for effecting separate and independent flushing thereof, and flushing means responsive to actuation of each of said toilet unit control means to flush the toilet unit associated therewith and to control the amount of flush water used in the flushing thereof, said flushing means including water refill means for providing refill water to said tank and said toilet units, said flushing means further including refill control means for separately and independently directing water from said water refill means to the respective toilet unit with which the actuated toilet unit control means is associated, said refill control means being further responsive to actuations of the toilet unit control means to inhibit supply of refill water to toilet units not associated with the actuated toilet unit control means.

2. The water closet construction defined in claim 1 wherein said water refill means includes an inlet water line, valve means associated with said inlet water line, float means operatively connected to the valve means to control the opening and closing thereof in response to the quantity of water in said water tank and to control the refilling of the tank after each flushing operation, and a plurality of overflow tubes, each of said overflow tubes being associated with a separate toilet unit and its associated toilet unit control means, each said overflow tube being communicatively connected to its associated toilet unit for passing water thereto, and wherein said refill control means includes means responsive to actuations of each of said toilet unit control means for independently and separately introducing water from said inlet water line into and through the overflow tube associated with the actuated toilet unit control means, and other means associated with said overflow tubes for permitting passage of water through only one of said overflow tubes for each actuation of each toilet unit control means.

3. A water closet construction adapted to service a plurality of distinct and spaced flush type toilet commodes which may have different flush water requirements, comprising a water tank having a first outlet for communicating with a first toilet commode, a second outlet for communicating with a second toilet commode, said second outlet being displaced on said tank from said first outlet to permit each of said outlets to be individually and separately communicatively connected to its respective toilet commode, first valve means associated with the first outlet including means for moving the first valve means relative to the first outlet to flush the first toilet commode independently of the second toilet commode with water from the water tank, said first valve means having means associated therewith for controlling the quantity of water discharged from the water tank through said first outlet to the first toilet commode, second valve means associated with the second outlet including means for moving the second valve means relative to the second outlet to flush the second toilet commode independently of the first toilet commode with water from the water tank, said second valve means having means associated therewith for controlling the quantity of water discharged from the water tank through said second outlet to said second toilet commode, and refill means including refill water supply means, tank refill means, and afterfill means, said tank refill means including means for providing refill water from said refill water supply means to said water tank and for refilling said water tank to a predetermined level after each flushing operation, said afterfill means including refill water directing means responsive to each flushing operation for independently and separately supplying refill water to one of said first and second toilet commodes depending upon which of said toilet commodes is flushed, said refill water directing means providing refill water directly from said refill supply means to said first toilet commode whenever said first toilet commode is flushed and directly from said refill supply means to said second toilet commode whenever said second toilet commode is flushed.

4. The water closet construction defined in claim 3 wherein said afterfill means includes first and second overflow tubes associated respectively with said first and second outlets and refill valve means actuatable by a flushing operation for supplying refill water to the toilet commode flushed, said refill water directing means directing refill water from said refill valve means to said first and second overflow tubes, and means for preventing refill water from said refill water directing means from entering said first overflow tube whenever said second toilet commode is flushed and from entering said second overflow tube whenever said first toilet commode is flushed.

5. A water closet construction comprising a tank having a first outlet, a second outlet, means for connecting the first outlet to a first toilet unit, means for connecting the second outlet to a second toilet unit physically distinct and spaced from said first toilet unit, a first valve seat associated with the first outlet and located in the tank at a predetermined level, a second valve seat associated with the second outlet and located in the tank at a different elevation than the first valve seat, first valve means associated with the first valve seat to control the flow of water from the tank to the first outlet, said first valve means including first actuator means operable to open the first valve seat to discharge water to the first outlet to individually flush the first toilet unit, second valve means associated with the second valve seat to control the flow of water from the tank to the second outlet, said second valve means including second actuator means operable to open the second valve seat to discharge water to the second outlet to individually flush the second toilet unit, means to refill the water tank to a predetermined level after the discharge of water from said tank regardless of whether the first or second toilet unit is flushed, said refill means including a refill control means for providing refill water to the toilet unit flushed and for inhibiting supply of refill water to the non-flushed toilet unit, a first operator actuatable lever mounted on the water tank, means operatively connecting said first lever to the first valve means to enable said first lever to be used to actuate said first valve means, a second operator actuatable lever mounted on the water tank, means operatively connecting said second lever to the second valve means to enable said second lever to be used to actuate said second valve means, said means for refilling the water tank to a predetermined level including an inlet water line and water valve means associated therewith, and float means operatively connected to said water valve means to control the opening and closing thereof in response to the amount of water in the tank, said refill control means being responsive to operation of said first operator actuatable lever to provide refill water from said inlet water line to said first toilet unit, said refill control means being responsive to operation of said second operator adjustable lever to provide refill water from said inlet water line to said second toilet unit.

6. The water closet construction defined in claim 5 wherein said refill means includes water supply means for supplying refill water to said water tank and said first and second toilet units, and wherein said refill control means includes first and second toilet unit refiller means associated respectively with said first and second toilet units, and control selection means for independently and separately providing refill water from said water supply means to each of said first and second toilet unit refiller means.

7. The water closet construction defined in claim 6 wherein said first toilet unit refiller means includes a first overflow tube communicatively connected to said first outlet, said second toilet unit refiller means includes a second overflow tube communicatively connected to said second outlet, and said control selection means includes selective direction means for selectively directing water from said water supply means into the overflow tube associated with the toilet unit that is flushed.

8. The water closet construction defined in claim 7 wherein said selective direction means includes means responsive to operation of said first actuator means to direct refill water into said first overflow tube and to operation of said second actuator means to direct refill water into said second overflow tube.

9. The water closet construction defined in claim 7 wherein said selective direction means includes first and second cap means for capping said first and second overflow tubes respectively, connection means for interconnecting said first and second cap means, means responsive to operation of said first actuator means to move said second cap means into engagement with said second overflow tube to cap said second overflow tube and to move said first cap means away from said first overflow tube to uncap said first overflow tube, said responsive means being also responsive to operation of said second actuator means to move said first cap means into engagement with said first overflow tube to cap said first overflow tube and to move said second cap means away from said second overflow tube to uncap said second overflow tube, and tube means for directing refill water from said refill supply means into said overflow tubes, each of said cap means when in engagement with its associated overflow tube preventing the introduction of refill water thereinto.

10. A combination toilet assembly comprising a first commode, a second commode physically distinct and spaced from said first commode, each of said commodes being separately and independently flushable, and a water closet for containing water for separately and independently flushing each of the first and second commodes, said water closet having a first outlet, means for connecting said first outlet to the first commode, a second outlet, means for connecting said second outlet to the second commode, a first valve seat associated with the first outlet and located in the tank at a predetermined elevation, first valve means associated with the first valve seat to separately and independently control the flow of water from the tank through the first outlet and to the first commode, a second valve seat associated with the second outlet and located in the tank at a predetermined elevation, second valve means associated with the second valve seat to separately and independently control the flow of water from the tank through the second outlet to the second commode, first actuator means including means mounted on the outside of the tank, means operatively connecting said first actuator means to the first valve means to control the opening and closing thereof and the discharge of water to the first outlet, second actuator means including means mounted on the outside of the tank, means connecting said second actuator means to the second valve means to control the opening and closing thereof and the discharge of water to the second outlet, means to refill the tank to a predetermined level after each actuation of the first or second actuator means, and commode refill means for providing refill water to the commode flushed and inhibiting supply of refill water to the non-flushed commode, said commode refill means responsive to each actuation of the actuator means.

11. The combination set forth in claim 10 wherein the first and second commodes are of different sizes, and wherein the first valve seat is at a different elevation in the tank than the second valve seat.

12. The combination set forth in claim 10 including means forming a common sewer connection for the discharge of the first and second commodes.

13. The combination set forth in claim 10 wherein said means to refill the tank includes an inlet water line, water valve means associated with the water line, and float means operatively connected to the water valve means to control the opening and closing thereof in response to the quantity of water contained in the tank and to control the refilling of the tank for each flushing operation, and wherein said commode refill means includes first and second overflow tubes for communicating respectively with said first and second outlets, each of said tubes extending above the predetermined water level of the water tank and having an open end thereat, means for introducing water from said inlet water line into said overflow tubes in response to actuations of said actuator means, and other means associated with said overflow tubes for allowing passage of water through only one of said overflow tubes for each actuation of one of said actuator means.

14. The combination set forth in claim 10 including means responsive to actuation of one of said actuator means for preventing flushing of the commode associated with the other of said actuator means until said one actuator means is de-actuated.

15. In a combination commode construction including a first toilet unit, a second toilet unit, a water closet tank common to said first and second toilet units, first toilet unit control means on said water closet tank associated with said first toilet unit, second toilet unit control means on said water closet tank associated with said second toilet unit, each of said toilet unit control means individually actuatable for effecting separate and independent flushing of the toilet unit with which it is associated, flushing means responsive to actuation of said first toilet unit control means to separately and independently flush said first toilet unit and to control the amount of flush water used in the flushing thereof, said flushing means further responsive to actuation of said second toilet unit control means to separately and independently flush said second toilet unit and to control the amount of flush water used in the flushing thereof, said flushing means including refill water means for providing refill water to said water closet tank, the improvement comprising toilet unit refill means for supplying refill water to said first and second toilet units, said toilet unit refill means including refill control means responsive to actuations of each of said first and second toilet unit control means for separately and independently directing and supplying refill water from said refill water means to the respective toilet unit with which the actuated toilet unit control means is associated, said refill control means being further responsive to actuations of each of said first and second toilet unit control means to inhibit supply of refill water to the toilet unit not associated with the actuated toilet unit control means.

16. A water closet construction comprising a tank having a first outlet, a second outlet, means for connecting the first outlet to a first toilet unit, means for connecting the second outlet to a second toilet unit physically distinct and spaced from said first toilet unit, a first valve seat associated with the first outlet and located in the tank at a predetermined level, a second valve seat associated with the second outlet and located in the tank at a different elevation than the first valve seat, first valve means associated with the first valve seat to control the flow of water from the tank to the first outlet, said first valve means including first actuator means operable to open the first valve seat to discharge water to the first outlet to individually flush the first toilet unit, second valve means associated with the second valve seat to control the flow of water from the tank to the second outlet, said second valve means including second actuator means operable to open the second valve seat to discharge water to the second outlet to individually flush the second toilet unit, means to refill the water tank to a predetermined level after the discharge of water from said tank regardless of whether the first or second toilet unit is flushed, said refill means including a refill control means for providing refill water to the toilet unit flushed and for inhibiting supply of refill water to the nonflushed toilet unit, said refill means including water supply means for supplying refill water to said water tank and said first and second toilet units, said refill control means including first and second toilet unit refiller means associated respectively with said first and second toilet units, and control selection means for independently and separately providing refill water from said water supply means to each of said first and second toilet unit refiller means, said first toilet unit refiller means including a first overflow tube communicatively connected to said first outlet, said second toilet unit refiller means including a second overflow tube communicatively connected to said second outlet, said control selection means including selective direction means for selectively directing water from said water supply means into the overflow tube associated with the toilet unit that is flushed, said selective direction means including means responsive to operation of said first actuator means to direct refill water into said first overflow tube and to operation of said second actuator means to direct refill water into said second overflow tube.

17. A water closet construction comprising a tank having a first outlet, a second outlet, means for connecting the first outlet to a first toilet unit, means for connecting the second outlet to a second toilet unit physically distinct and spaced from said first toilet unit, a first valve seat associated with the first outlet and located in the tank at a predetermined level, a second valve seat associated with the second outlet and located in the tank at a different elevation than the first valve seat, first valve means associated with the first valve seat to control the flow of water from the tank to the first outlet, said first valve means including first actuator means operable to open the first valve seat to discharge water to the first outlet to individually flush the first toilet unit, second valve means associated with the second valve seat to control the flow of water from the tank to the second outlet, said second valve means including second actuator means operable to open the second valve seat to discharge water to the second outlet to individually flush the second toilet unit, means to refill the water tank to a predetermined level after the discharge of water from said tank regardless of whether the first or second toilet unit is flushed, said refill means including a refill control means for providing refill water to the toilet unit flushed and for inhibiting supply of refill water to the non-flushed toilet unit, said refill means including water supply means for supplying refill water to said water tank and said first and second toilet units, said refill control means including first and second toilet unit refiller means associated respectively with said first and second toilet units, and control selection means for independently and separately providing refill water from said water supply means to each of said first and second toilet unit refiller means, said first toilet unit refiller means including a first overflow tube communicatively connected to said first outlet, said second toilet unit refiller means including a second overflow tube communicatively connected to said second outlet, said control selection means including selective direction means for selectively directing water from said water supply means into the overflow tube associated with the toilet unit that is flushed, said selective direction means including first and second cap means for capping said first and second overflow tubes respectively, connection means for interconnecting said first and second cap means, means responsive to operation of said first actuator means to move said second cap means into engagement with said second overflow tube to cap said second overflow tube and to move said first cap means away from said first overflow tube to uncap said first overflow tube, said responsive means being also responsive to operation of said second actuator means to move said first cap means into engagement with said first overflow tube to cap said first overflow tube and to move said second cap means away from said second overflow tube to uncap said second overflow tube, and tube means for directing refill water from said refill supply means into said overflow tubes, each of said cap means when in engagement with its associated overflow tube preventing the introduction of refill water thereinto.

18. A water closet construction adapted to service first and second flush type toilet units comprising a water tank common to the first and second toilet units for supplying flush water for each, user actuatable toilet unit control means for effecting flushing of the first and second toilet units, said toilet unit control means including a first controller portion operable to effect flushing of the first toilet unit separately and independently of the second toilet unit and a second controller portion operable to effect flushing of the second toilet unit separately and independently of the first toilet unit, flushing means responsive to operation of each of said first and second controller portions of said toilet unit control means to flush the toilet unit associated therewith and to control the amount of flush water used in the flushing thereof, said flushing means including water refill means for providing refill water to said water tank and said toilet units, said flushing means further including refill control means for separately and independently directing water from said water refill means to the first toilet unit when the first controller portion of the toilet unit control means is operated and to the second toilet unit when the second controller portion of the toilet unit is operated, said refill control means being further responsive to each actuation of the toilet unit control means to inhibit supply of refill water to the respective unit associated with the non-operated controller portion of said toilet unit control means.

19. The water closet construction defined in claim 18 wherein said water refill means includes an inlet water line, valve means associated with said inlet water line, float means operatively connected to the valve means to control the opening and closing thereof in response to the quantity of water in said water tank and to control the refilling of the tank after each flushing operation, and first and second overflow tubes each of which is associated with a respective toilet unit and its associated controller portion of said toilet unit control means, each said overflow tube being communicatively connected to its associated toilet unit for passing water thereto, and wherein said refill control means includes means responsive to operations of each of said first and second controller portions of said toilet unit control means for independently and separately introducing water from said inlet water line into and through the overflow tube associated with the operated controller portion of said toilet unit control means, and other means associated with said overflow tubes for permitting passage of water through only one of said first and second overflow tubes for each actuation of said toilet unit control means.

* * * * *